US009271888B2

(12) United States Patent
Park et al.

(10) Patent No.: US 9,271,888 B2
(45) Date of Patent: Mar. 1, 2016

(54) TRANSFER ROBOT FOR CARING FOR PATIENT

(71) Applicant: KOREA INSTITUTE OF INDUSTRIAL TECHNOLOGY, Chungcheongnam-do (KR)

(72) Inventors: Hyun Sub Park, Gyeonggi-do (KR); In Hoon Jang, Gyeonggi-do (KR); Jun Young Jung, Gyeonggi-do (KR); Hyun Dae Yang, Gyeonggi-do (KR); Chul Je Park, Gyeonggi-do (KR); Min Gi Chae, Busan (KR)

(73) Assignee: KOREA INSTITUTE OF INDUSTRIAL TECHNOLOGY, Chungcheongnam-do (KR)

( * ) Notice: Subject to any disclaimer, the term of this patent is extended or adjusted under 35 U.S.C. 154(b) by 0 days.

(21) Appl. No.: 14/437,815

(22) PCT Filed: Sep. 5, 2013

(86) PCT No.: PCT/KR2013/008023
§ 371 (c)(1),
(2) Date: Apr. 22, 2015

(87) PCT Pub. No.: WO2014/065504
PCT Pub. Date: May 1, 2014

(65) Prior Publication Data

US 2015/0272800 A1 Oct. 1, 2015

(30) Foreign Application Priority Data

Oct. 22, 2012 (KR) ..... 10-2012-0117258

(51) Int. Cl.
*A61G 5/04* (2013.01)
*A61G 7/10* (2006.01)

(52) U.S. Cl.
CPC ..... *A61G 7/1019* (2013.01); *A61G 7/1046* (2013.01); *A61G 7/1053* (2013.01)

(58) Field of Classification Search
CPC ..... A61G 5/04
USPC ..... 5/81.1, 83.1, 86.1, 87.1
See application file for complete search history.

(56) References Cited

U.S. PATENT DOCUMENTS

| | | | | |
|---|---|---|---|---|
| 4,157,593 A * | 6/1979 | Kristensson | ..... | 5/87.1 |
| 4,435,863 A * | 3/1984 | Lerich | ..... | 5/87.1 |
| 4,569,094 A | 2/1986 | Hart et al. | | |
| 6,880,202 B2 * | 4/2005 | Thompson et al. | ..... | 16/35 R |

FOREIGN PATENT DOCUMENTS

| | | | |
|---|---|---|---|
| JP | 06-225909 | A | 8/1994 |
| JP | 06-254123 | A | 9/1994 |
| JP | 2010-088786 | A | 4/2010 |
| JP | 2010-227162 | A | 10/2010 |
| KR | 20-0300249 | Y1 | 5/2003 |

* cited by examiner

*Primary Examiner* — Fredrick Conley
(74) *Attorney, Agent, or Firm* — IP Legal Services, LLC

(57) ABSTRACT

Disclosed is a transfer robot for caring for a patient. The robot includes a body section against which the upper half of the body of a patient is leaned, a first clamp which is rotatably provided on one side of the body section for supporting the upper half of the body of the patient, a second clamp, which is provided at a position adjacent to the first clamp so that the position of the second clamp is able to be changed, for supporting the lower half of the body of the patient, a prop which is extendedly arranged below the body for adjusting the height of the body section, and a transfer board, which is connected to the prop, for rotating and moving positions.

15 Claims, 11 Drawing Sheets

TRANSFER ROBOT FOR CARING FOR PATIENT

TECHNICAL FIELD

The present disclosure relates, in general, to a transfer robot for caring for a patient and, more particularly, to a transfer robot which enables a quick transfer of a patient and maintains a comfortable riding position thereon of a patient, thereby minimizing the stresses of the patient and his/her care worker occurring during patient's riding and moving stages and thus preventing both the patient and his/her care worker from being stressed from each other, and also minimizing manufacturing and maintenance costs.

BACKGROUND ART

Generally, disabled persons need to have help from anyone to move. That is, disabled persons always need to be cared by a care worker.

The care worker should stay up with a patient and help a patient or assist a patient in transferring to an object such as a wheelchair when he/she moves. When the patient moves, if the care worker has good physical condition, there is no problem in helping or assisting the patient, whereas, if the care worker has worse physical condition or is older, he/she hardly help or assists the patient with the movement or transfer to other location, causing the care worker to be greatly stressed both physically and mentally. For this reason, recently there are fewer care workers than peoples want to employ.

In order to help both a patient and a care worker caring for the patient, there have been developed both devices for transferring a patient in a manner of carrying the patient thereon, and devices for moving a lying patient as he/she is.

However, in the case of typical carrying devices, problems may occur in that, since it takes a lot of time to move a patient to a carrying robot, or a riding position of a patient is very discomfortable, the patient often suffers pain when he/she is moving.

Further, another problem may occur in that a typical carrying robot has a complicated structure and is difficult-to manipulate by a single care worker, and causes expensive manufacturing and maintenance costs.

Further, in the case of a robot horizontally moving a lying patient, problems may arise in that, since the robot has a shape like a forklift, when moved, a patient may feel that he/she is treated as a piece of luggage, so that the patient does not want to use it, and the robot also causes expensive manufacturing and maintenance costs.

DISCLOSURE

Technical Problem

Accordingly, the present disclosure has been made keeping in mind the above problems occurring in the prior art, and an object of the present disclosure is to provide a transfer robot which enables a quick transfer of a patient and maintains a comfortable riding position thereon of a patient, thereby minimizing the stresses of the patient and his/her care worker occurring during patient's riding and moving stages and thus preventing both the patient and his/her care worker from being stressed from each other, and also minimizing manufacturing and maintenance costs.

Technical Solution

In order to accomplish the above object, at least one embodiment of the present invention provides a transfer robot for caring for a patient, including: a body section against which the upper half of the body of a patient is leaned; a first clamp which is rotatably provided on one side of the body section for supporting the upper half of the body of the patient; a second clamp, which is provided at a position adjacent to the first clamp so that the position of the second clamp is able to be changed, for supporting the lower half of the body of the patient; a prop which is extendedly arranged below the body section for adjusting the height of the body section; and a transfer board, which is connected to the prop, for rotating and moving positions.

The first clamp may include an elastic belt, and fixing protrusions configured to detachably connect the belt to the body section.

The second clamp may include an elastic belt, and fixing protrusions configured to detachably connect the belt to the body section, wherein each of the fixing protrusions is configured to be fixedly moved along a slot formed in the body section to suit the length of the lower half of the patient so as to adjust a distance from the body section.

The body section may have an inclined surface with which the patient comes into close contact.

An inclined angle of the inclined surface may range from 45 degrees to 65 degrees relative to an imaginary horizontal line, and the second clamp may preferably be positioned to support the thighs of the patient at a position separated by 40 to 60% of the total length of the thighs from the knee joints.

The prop may include an upper casing connected to the body section, a lower casing inserted into the upper casing and connected to the transfer board, a lifting cylinder inserted into the upper and lower casings and connecting the body section and the transfer board, an operation lever provided on the body section to control the lifting cylinder, and a driver operating the lifting cylinder.

The body section may include a handle having the operation lever.

The transfer board may include a frame having wheels, a connection part rotatably connecting the prop and the frame, and a support part arranged between the frame and the connection part to support the driver.

At least one of the wheels may include a stopper.

The connection part may include a stepper allowing a gradational rotation of the prop.

The stepper may be a toggle clamp that is provided between the prop and the frame to allow the prop to be clamped to the frame.

The stepper may include a housing provided on the prop with an internal space formed therein, a vertical shaft vertically moving in the housing in a state of being supported by a spring, and an extended shaft extending from a lower end of the vertical shaft and configured to be moved into and out of insertion holes, equidistantly formed in an upper surface of a cylindrical member of the frame along a circumference thereof, in association with the vertical movement of the vertical shaft, allowing the prop to gradationally rotate about the frame.

The prop may include a post installed vertically upward from the transfer board, a bracket fixed to a planar surface of the post, a cylinder, a lower end of which is rotatably supported by the bracket, an arm member rotatably supported by the post via a rotary shaft at one end and supporting the body section via a fixing part at the other end, and a fixing shaft fixed to the arm member to rotatably support the cylinder.

Advantageous Effects

According to the present disclosure, the transfer robot enables a quick transfer of a patient and maintains a comfortable riding position thereon of a patient, thereby minimizing the stresses of the patient and his/her care worker occurring during patient's riding and moving stages and thus preventing both the patient and his/her care worker from being stressed from each other, and also minimizing manufacturing and maintenance costs.

MODE FOR DISCLOSURE

Embodiments of the present invention will be described below in more detail with reference to the accompanying drawings. It should be understood that the following specific structural and functional descriptions are merely examples given for the purpose of providing a description of the exemplary embodiments according to the concept of the present invention. Accordingly, various variations may be performed on the exemplary embodiments of the present invention, and it should be understood that the scope and spirit of the present invention will not be limited only to the exemplary embodiments presented in the description of the present invention set forth herein.

The terms including expressions, such as first and/or second, used in the specification of the present invention may be used to describe various elements of the present invention. However, the elements of the present invention should not be limited by the terms used in the specification of the present invention. In other words, such terms will be used only to differentiate one element from other elements of the present invention.

The terminology used in the specification of the present invention is for the purpose of describing particular embodiments only and is not intended to limit the invention. As used in the specification and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
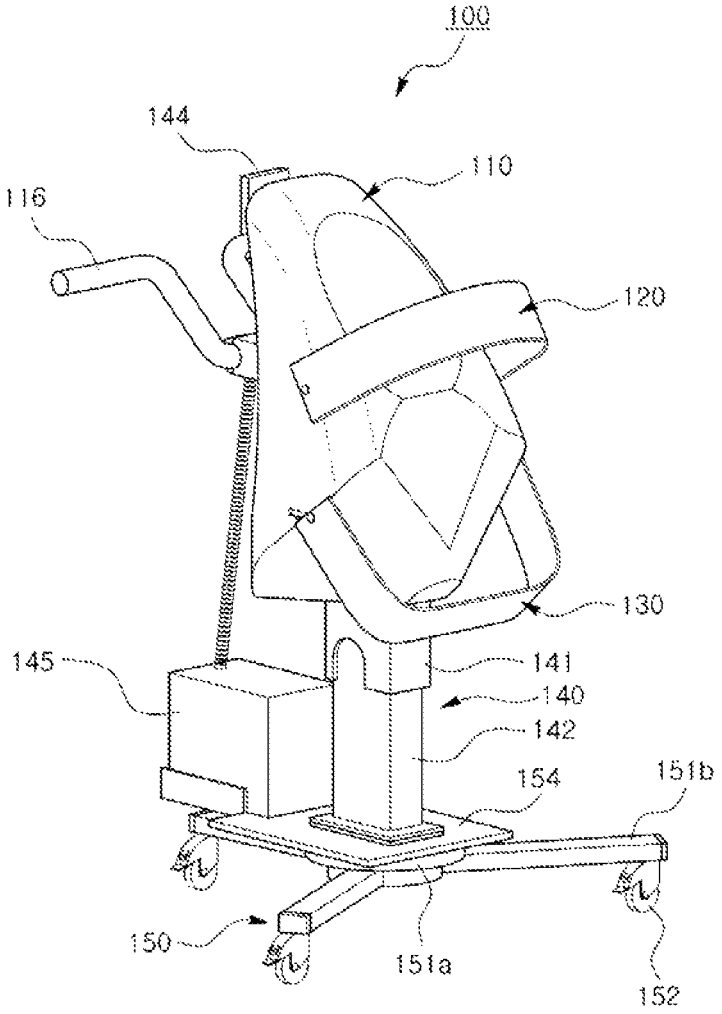
FIG. 1 is a perspective view of a transfer robot for caring for a patient according to a first embodiment of the present invention.
Figure 2:
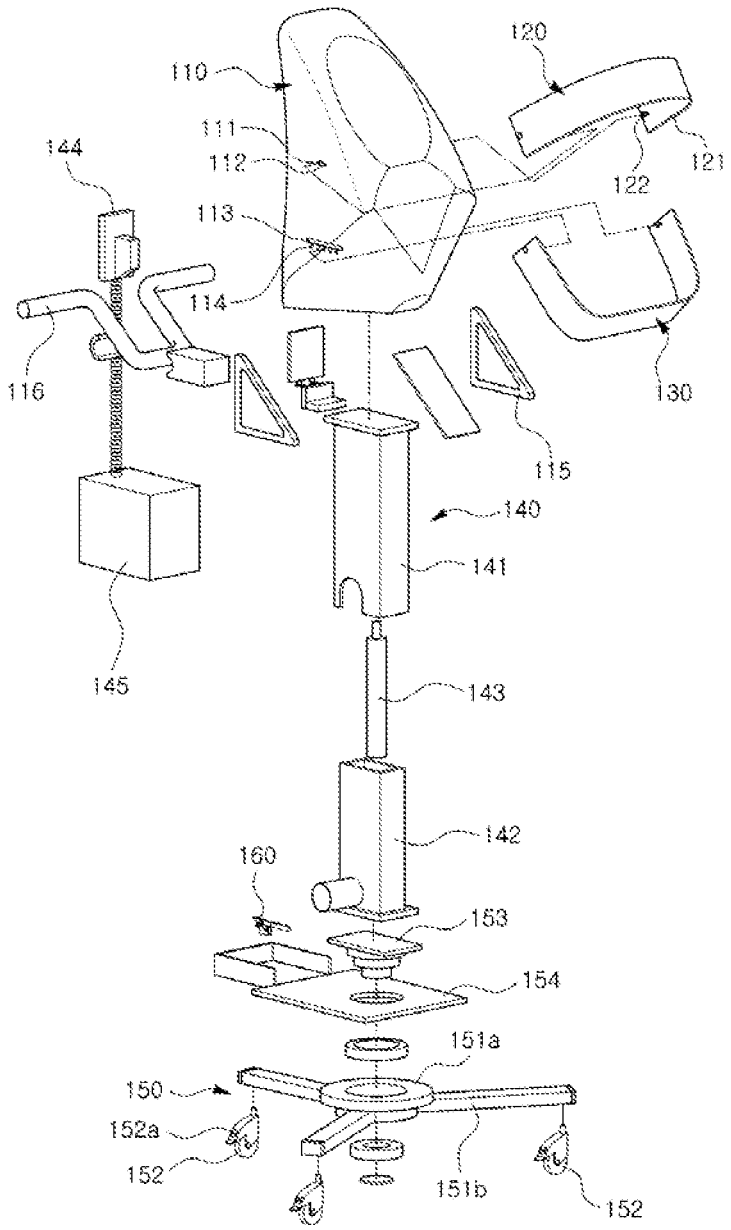
FIG. 2 is an exploded perspective view of the transfer robot shown in FIG. 1.

As shown in FIGS. 1 and 2, a transfer robot 100 for caring for a patient includes a body section 110, a first clamp 120, a second clamp 130, a prop 140, and a transfer board 150.

The body section 110 has an inclined surface with which a patient comes into close contact so that the patient is naturally carried on the inclined surface in a close-contacted manner.

The body section 110 is provided with an insertion hole 111 having a specified diameter on each of left and right sides at a middle portion thereof, wherein a semi-circular engaging hole 112 having a diameter smaller than that of the insertion hole is formed horizontally adjacent the insertion hole 111, and a horizontal slot 113 provided below the insertion hole, wherein semi-circular engaging holes 114 are equidistantly formed below the slot 113.

That is, the insertion holes 111 at the middle portion are used to be coupled with the first clamp, and the slots below the insertion holes are used to be coupled with the second clamp.

Further, the body section 110 is provided therein with coupling members 115 which allow the prop, which will be described later, to be inserted and installed into the body section, and a horizontally extended handle 116 is provided in front of the coupling members 115.

An inclined angle of the inclined surface of the body section 110 ranges from 45 degrees to 65 degrees relative to a horizontal line (not shown), and preferably takes 55 degrees in order to maintain a stable position.

This angle is an angle at which, when a patient is carried on the body section in a close-contacted manner, the patient can take a most-comfortable riding position.

The first clamp 120 includes an elastic belt 121 having a specified length and fixing protrusions 122 provided on both sides of the belt 121.

Herein, for example, the belt 121 is preferably formed of such a material which is employed to form a safety belt for a vehicle. The length of the belt can be adjusted in the same manner as in a buckle. This is for allowing a patient to be stably brought into close contact with the body section by the first clamp when the patient has a larger or smaller build than a standard build.

Like in the second clamp which follows, the insertion hole of the body section of the first clamp may be formed like a horizontal slot for adjusting the length of the first clamp.

As shown in FIG. 2, the fixing protrusion 122 has a stepped shape so that the protrusion is inserted into the relatively-large insertion hole 111 and is moved into and engaged with the relatively-small engaging hole 112.

The second clamp 130 has the same shape as the first clamp, and therefore a detailed description thereof will be omitted.

In the meantime, the first and second clamps 120 and 130 preferably have a width of less than 10 cm in order to support the patient in a stable position, and the second clamp may preferably be positioned to support the thighs of the patient at a position separated by 40 to 60% of the total length of the thighs from the knee joints. This is because the lower half of the patient can be stably supported when the thighs of the patient at a position separated by 40 to 60% of the total length of the thighs from the knee joints are supported.

The prop 140 includes an angular upper casing 141 which has a closed upper part and an open lower part, a lower casing 142 which has a shape corresponding to the shape of the upper casing 141 and is configured to be inserted into the upper casing 142, a lifting cylinder 143 which is disposed between the upper and lower casings 141 and 142 so as to mutually support them, an operation lever 144 which is attached to a handle 116 of the body section 110 to operate the lifting cylinder 143, and a driver 145 which forms a hydraulic circuit between the lifting cylinder 143 and the operation lever 144 so as to supply hydraulic fluid to the lifting cylinder to move the lifting cylinder in response to the manipulation of the operation lever.

That is, the prop 140 is configured to adjust the height of the body section 110 by vertically moving the body section 110 relative to the transfer board 150 with the manipulation of the operation lever 144.

Herein, the operation lever 144 has up and down buttons to move the prop in a vertical direction. The up and down buttons are selectively pushed so as to operate a hydraulic motor and therefore the lifting cylinder.

Although not shown in the drawings, the driver 145 may have a battery for operating the hydraulic motor, and a power jack for charging the battery.

The transfer board 150 includes a frame 151, a plurality of wheels 152, a connection part 153, and a support part 154.

The frame 151 has a cylindrical member 151*a* having a central hole, and three extended parts 151*b* which extend radially from the center of the cylindrical member 151*a*.

The wheel 152 includes a commonly used caster, which is however provided with an upper stopper 152*a* as shown in the drawings.

The connection part 153 includes a plate, on which the lower casing of the prop is located, and a cylindrical extension which is provided below the plate such that the cylindrical extension is rotatably coupled with the central hole of the cylindrical member 151*a* via a bearing.

The connection part 153 is further provided with a stepper 160 for allowing stepwise rotation. The stepper 160 is a toggle clamp which is provided between the support part 154 of the prop 140 and the cylindrical member 151*a* of the frame 151 so as to allow the support part 154 to be clamped with respect to the cylindrical member 151*a*.

Figure 3:
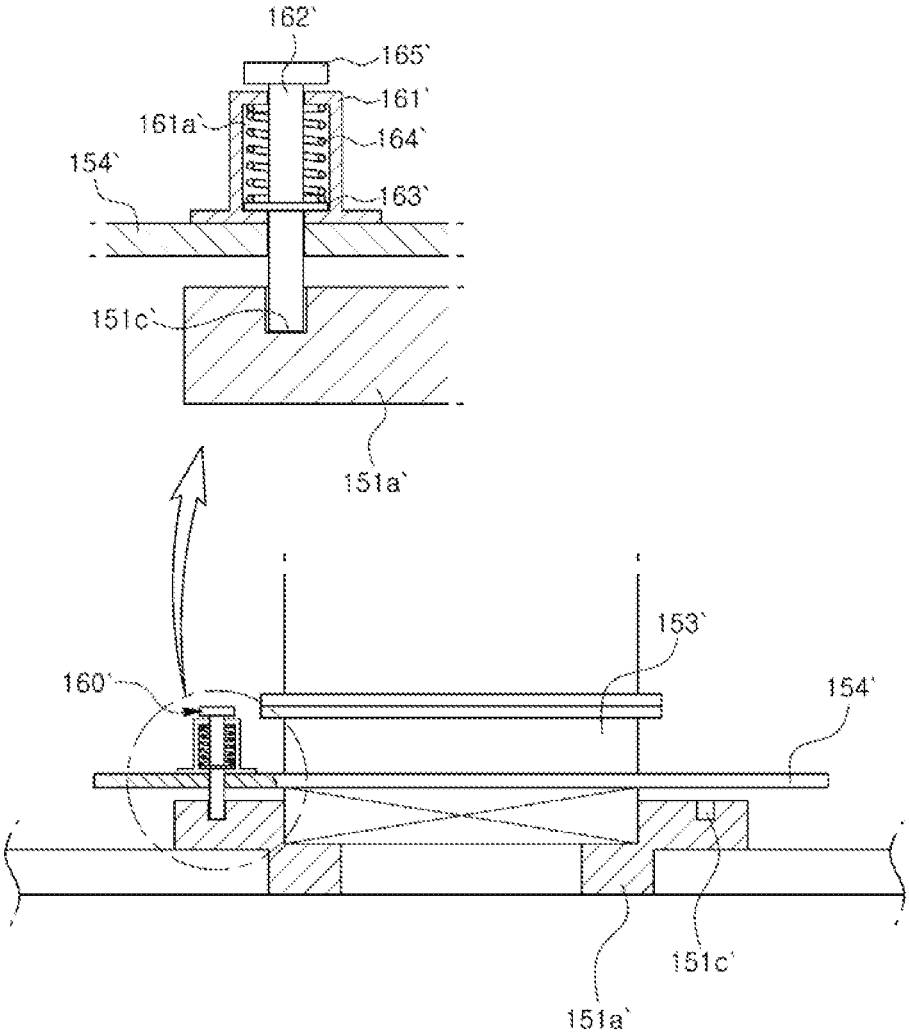
FIG. 3 is a cross-sectional view of a stepper according to another embodiment of the stepper shown in FIG. 2.

Instead of using the toggle clamp, it is possible to use a stepper 160' as shown in FIG. 3.

The stepper 160' includes a housing 161' which is provided on the prop 154, with an internal space 161*a*' formed therein, a vertical shaft 162' which vertically moves in the housing 161' in a state of being supported by a spring 164' engaged with a fixture 163', and an extended shaft 166' which extends from a lower end of the vertical shaft and is configured to be moved into and out of insertion holes 151*c*', equidistantly formed in an upper surface of a cylindrical member 151*a*' of the frame 151 along a circumference thereof, in association with the vertical movement of the vertical shaft 162', allowing the prop to rotate about the frame step by step.

Further, the vertical shaft 160' is provided thereon with a grip 165' for pulling the vertical shaft.

In operation of the stepper 160', when the grip 165' is pulled upwards in order to rotate a connection part 153' in a desired direction with respect to the cylindrical member 151*a*', the vertical shaft 162' is moved up so that the extension shaft 166', which was engaged with the insertion hole 151*c*, is disengaged from the insertion hole 151*c*, being in an unlocked state in which the connection part 153' can be rotated in a desired direction, with the spring 164' compressed between the fixture 163' and an upper wall in the internal space 161*a*' of the housing 161'. When the rotation is terminated, the grip is released and returns to its original position due to the restoration force of the compressed spring so that the extension shaft is inserted into the insertion hole, being in a locked state. As a result, it is possible to rotate the connection part only when a user wants to rotate.

Experimental examples of the transfer robot according to the present invention will be described below with respect to conditions of allowing a patient to be supported while taking a stable position.

<Experiment 1>

Experimental Conditions

Figure 4:
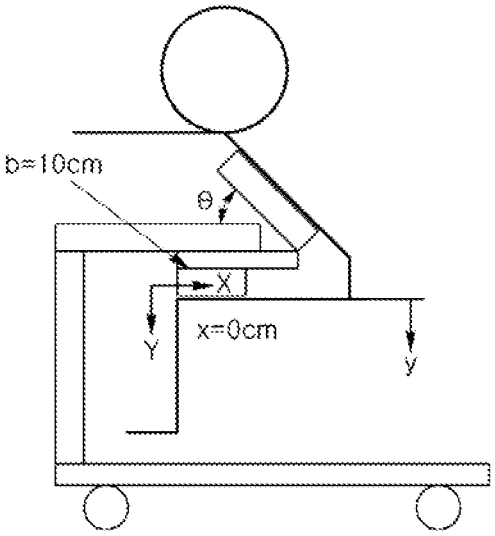
FIGS. 4 and 5 are schematic views showing experimental examples of the present invention.

In FIG. 4, where θ is a tilt angle (°) of the upper half, y is an amount (e.g., cm) of sagging of the hips, b is a width (e.g., 10 cm) of a belt, and x is a distance (e.g., fixed to 0 cm) from the back of the knee to the thigh belt, (θ, y) is set to a variable and (b, x) is set to a constant.

The thigh of a patient was brought into close contact with a belt at a position where the amount of the sagging of the hips is 0 cm, and an experiment was carried out, considering the time when a line drawn between the thigh and the hips is parallel with the ground as a reference.

Table 1 shows a result of wearing sensation that a patient feels when he/she wears the transfer robot in a condition that a tilt angle of the upper half of the patient is varied based on the preset reference.

TABLE 1

| Example | Angle of upper half (degree) | Hip-sagging (cm) | Wearing sensation (comfort) |
|---|---|---|---|
| 1 | 30 | 2 | X (breathless) |
| 2 | 40 | 4 | X (feel pain in solar plexus area) |
| 3 | 50 | 6 | Δ |
| 4 | 60 | 8 | Δ |
| 5 | 70 | 10.5 | Δ |
| 6 | 80 | 12.5 | X (leaning of upper half to back side) |
| 7 | 90 | 16.5 | X (leaning of upper half to back side) |

X represents a state that a patient feels very uncomfortable, and Δ represents a state that a patient feels comfortable.

As shown in Table 1, it could be known that, when the tilt angle of the upper half of the patient was very inclined toward the horizontal direction, hip-sagging was relatively small, but the upper half was greatly compressed against the body section because the upper half of the patient was relatively greatly folded. On the contrary, it could be known that, when the tilt angle of the upper half was close to verticality, the hip-sagging increased and thus the center of mass of the upper half moved behind the upper half so that there was no pressure of the upper half against the body section, but the waist of the upper half was leaning to one side and was strained.

Thus, the inclined angle of the body section 110 supporting the upper half of the patient preferably ranges from 50 degrees to 60 degrees in order to reduce the leaning phenomenon and the pressure of the upper half against the body section, thereby maintaining a stable position.

Unlike Experiment 1 with respect to the position of the upper half according to the inclined angle of the body section, Experiment 2 is directed to a position capable of stably maintaining the lower half of a patient.

<Experiment 2>

Experimental Conditions

Figure 5:
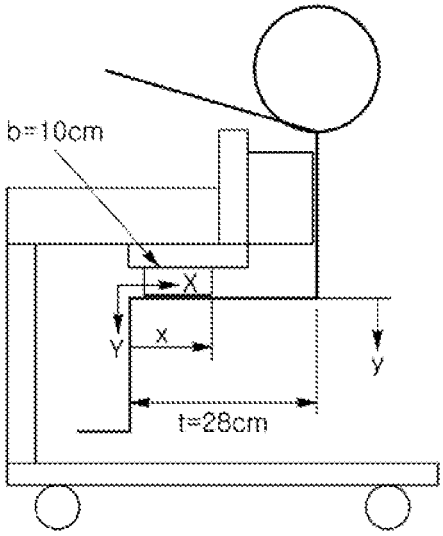

In FIG. 5, where x is a distance (cm) from the back of the knee to the thigh belt, y is an amount (cm) of sagging of the hips, b is a width (cm) of a belt, t is a length of a patient, and an angle of the upper half is set to 90 degrees, (x, y) is set to a variable and (b, t) is set to a constant.

The thigh of a patient was brought into close contact with a belt at a position where the amount of the sagging of the hips is 0 cm, and an experiment was carried out, considering the time when a line drawn between the thigh and the hips is parallel with the ground as a reference.

TABLE 2

| Example | Distance from knee to belt (x) | Ratio of thigh (%) | Hip-sagging (y) | Wearing sensation (comfort) |
|---|---|---|---|---|
| 1 | 0 | 0 | 14.5 | X (pressure on chest and abdomen) |
| 2 | 4 | 14.29 | 14 | X (pressure on chest and abdomen) |
| 3 | 7.8 | 27.86 | 13.5 | X (pressure on chest) |
| 4 | 12.1 | 43.21 | 9.5 | Δ (comfort) |
| 5 | 16 | 57.14 | 7.5 | Δ (comfort) |

X represents a state that a patient feels very uncomfortable, and Δ represents a state that a patient feels comfortable.

As shown in Table 2, it could be known that Experimental Examples 1 to 3 showed that a patient suffered from severe pressure at his/her chest and abdomen because the distance (x) from the knee to a support position was close so the hip-sagging was relatively greatly increased, whereas Experimental Examples 4 and 5 showed that the patient could maintain a stable position because the distance from the knee to the support position became relatively short.

Thus, it could be known that the patient could maintain a stable position when the patient took a position so that a ratio of the support position to the length of the thigh of the patient ranged from 40% to 60%. Thus, according to one or more embodiments of the present invention, the distance from the second clamp to the body section is adjusted in response to the length of the thigh of the patient in order to maintain a stable position.

As shown in Experiments 1 and 2, according to one or more embodiments of the present invention, the upper half of a patient can maintain a most-stable position by adjusting the inclined angle of the body section and the first clamp, and the lower half of the patient can also be stably supported by adjusting the second clamp such that the second clamp has an optimal support position in response to the length of the thigh of the patient.

The assembly of the transfer robot according to at least one embodiment of the present invention will be described below.

A bearing is inserted into the central hole of the cylindrical member 154 of the frame 151, and wheels 152 are respectively coupled to ends of the extended parts 151*b*.

Herein, the bearing is preferably a thrust bearing.

Thus, the support part 154 is located such that an opening thereof (not shown) formed in one side is positioned above the bearing, a lower cylindrical portion of the connection part 153 is inserted into the bearing through the opening, and the connection part 153 and the support part 154 are coupled together.

Next, the stepper 160 is positioned between the lower portion of the support part 154 and the cylindrical member 151*a* such that one side thereof is fixed to the support part 154 and the other side is closely coupled to the outer surface of the cylindrical member 151*a*.

Then, the driver 145 is coupled to one side of the support part 154. Herein, the driver 145 includes a tank for storing fluid (e.g., oil), a hydraulic motor for moving fluid, a battery for activating the hydraulic motor, and a closed fluid-circuit.

Next, a lower end of the lower casing 142 of the prop 140 is coupled with the connection part 153, and the lifting cylinder 143 is fixed to the inside of the lower casing such that the lifting cylinder 143 is coupled with the closed hydraulic circuit provided in the driver 145.

Then, the upper casing 141 is coupled in such a manner as to be supported by the lifting cylinder 143 while surrounding the lower casing 142.

In this state, the coupling member 115 provided in the body section 110 and the upper casing 141 are fixedly coupled, the handle 116 is mounted in front of the body section from the coupling member 115 so as to extend in the horizontal direction, and the operation lever 144 is installed in the handle 116 to control the driver 143.

Herein, the operation lever 144 is electrically connected with the driver. While the operation lever is illustrated in the drawings as being extended outwards, it is possible to install the operation lever along the inside of the prop.

In the meantime, while the embodiment describes that a toggle clamp is used as the stepper 160, the stepper 160' shown in FIG. 3 may also be used.

Next, the first clamp 120 of a certain length is engaged with the insertion hole 111 of the body section 110, and the second clamp 130 is engaged with the slot 113 provided below the insertion hole.

According to at least one embodiment of the present invention, the length of the first and second clamps and/or the inclined angle of the body section are adjusted in an optimal state to suit the physical condition of a patient, thereby maintaining a stable position.

The operation of the transfer robot according to at least one embodiment of the present invention will be described below with reference to the accompanying drawings.

Figure 6:
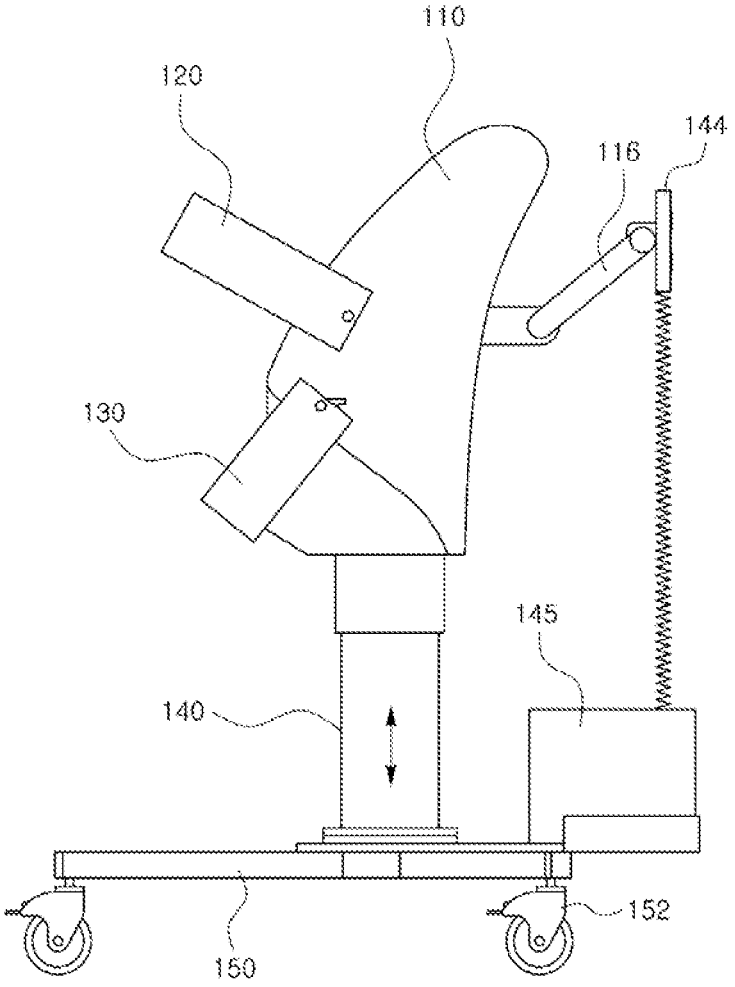
FIGS. 6 to 9 are views showing the operation of the transfer robot according to at least one embodiment of the present invention.
Figure 7:
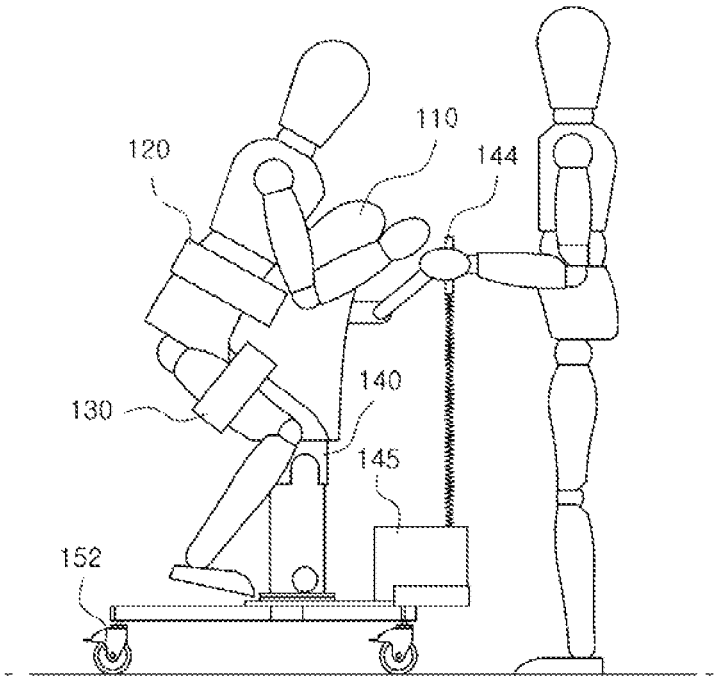

Referring to FIGS. 6 and 7, the position of the body section 110 is adjusted to suit the level at which a patient is positioned. This is done by manipulating the operation lever 144 provided on the handle 116 so that the driver 145 adjusts the height of the prop 140.

In this state, when the height of the body section 110 is adjusted to suit the position of the patient, a care worker disengages the first and second clamps 120 and 130 from the body section and moves the patient close to the body section 110.

Then, one fixing protrusion of the second clamp is inserted into and engaged with the slot of the body section and then the other fixing protrusion of the second clamp is inserted into and engaged with another slot of the body section while surrounding and supporting the thigh of the patient with the belt of the second clamp to suit the length of the thigh of the patient, thereby allowing the patient to be supported by the body section with the thigh of the patient supported by the second clamp.

That is, as shown in Experiment 2, the thigh of the patient is allowed to be supported by the second clamp at a position of the thigh that ranges 40% to 60% of the whole length of the thigh.

In this state, when the lower half of the patient is supported by the second clamp 130, the care worker tilts the upper half of the patient close to the inclined surface of the body section 110, and then engages the first clamp 120 with the body section 110 while surrounding and supporting the patient at the back with the patient carried on the body section.

Herein, the first and second clamp may adjust their length by means of a buckle or the like, in order to suit the physical condition of the patient.

Next, after the patient mounts the transfer robot, wheels, which were locked by stoppers, are unlocked, and then the patient can be moved toward a desired location by a care worker steering the transfer robot with the handle.

Figure 8:
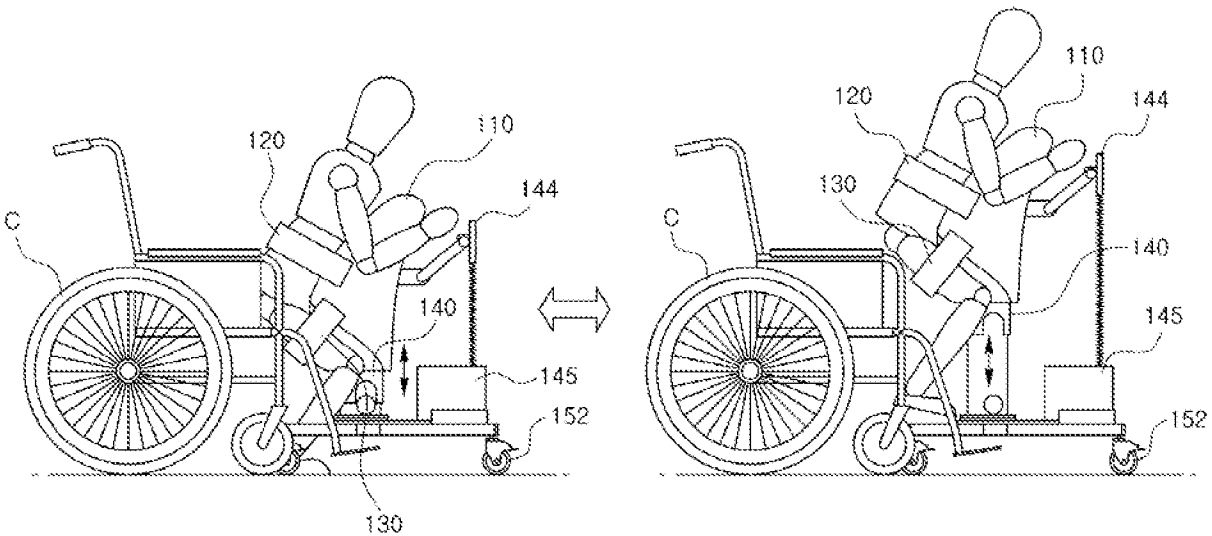

Further, in the case where the patient is sitting on a wheelchair "C" as shown in FIG. 8, after the prop 140 and the body section 110 are moved down by the manipulation of the operation lever 144 to suit the level of the patient sitting on the wheelchair, the second clamp 130 is supported by the body section while surrounding the thigh of the patient, the first clamp 120 supports the upper half of the patient such that the upper half is supported by the body section in a close-contacted manner, and then the prop 140 is moved up to a certain level by the manipulation of the operation lever 144 so that the patient can be stably supported by the first and second clamps in a close-contacted manner with the body section, thereby being in a state of the care worker being able to easily move the transfer robot and the patient who mounted the robot.

Herein, the transfer board 150 may be in a fixed state by locking the wheels using the stoppers. Further, in order to allow the patient to be easily transferred to the transfer robot, after the body section is tilted such that the frame of the transfer board can approach the wheelchair between footholds thereof, on which the patient steps, as close as possible, the patient is transferred.

On the contrary, where a patient who mounted the transfer robot is transferred to the wheelchair, the body section 110 is moved down to suit the level of the wheelchair, a care worker unlocks the second clamp and then moves the patient so that the patient sits on the wheelchair, and then unlocks the first clamp so that center of mass of the patient naturally moves towards the wheelchair, thereby enabling the patient to sit on the wheelchair in a stable position.

Figure 9:
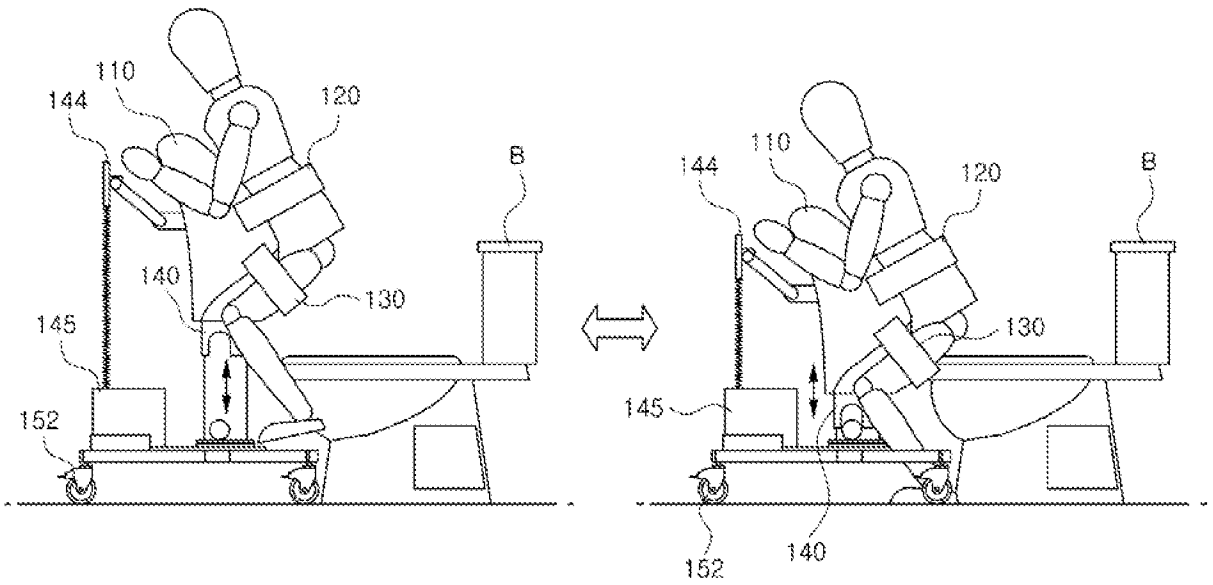

Similarly, where a patient uses a toilet bowl (B), as shown in FIG. 9, the body section 110 is rotated such that the wheels 152 of the transfer board 150 are positioned at right and left sides relative to the toilet bowl, in order to position the patient who is mounting the transfer robot as close to the toilet bowl "B" as possible. Herein, the rotation of the body section 110 is carried out using the stepper 160, 160' as shown in FIGS. 2 and 3.

After the rotation is completed, the wheels are rotation-locked using the stoppers, and the prop 140 is moved down by the operation lever 144 so that the level of the body section is close to the level of the toilet bowl.

Then, after the second clamp 130 is disengaged from the body section 110 so that the lower half of the patient can be supported by the toilet bowl, the first clamp 120 is disengaged from the body section so that the patient can naturally sit on the toilet bowl, thereby allowing the patient to be comfortably transferred in a stable position and allowing the care worker to easily assist in transferring the patient.

Like this, the transfer robot according to the present invention enables quick movement and transfer of a patient, thereby minimizing the number of the care workers and therefore time and cost for caring for a patient and also minimizing the stresses of the patient and his/her care worker occurring during patient's riding and moving stages.

Figure 10:
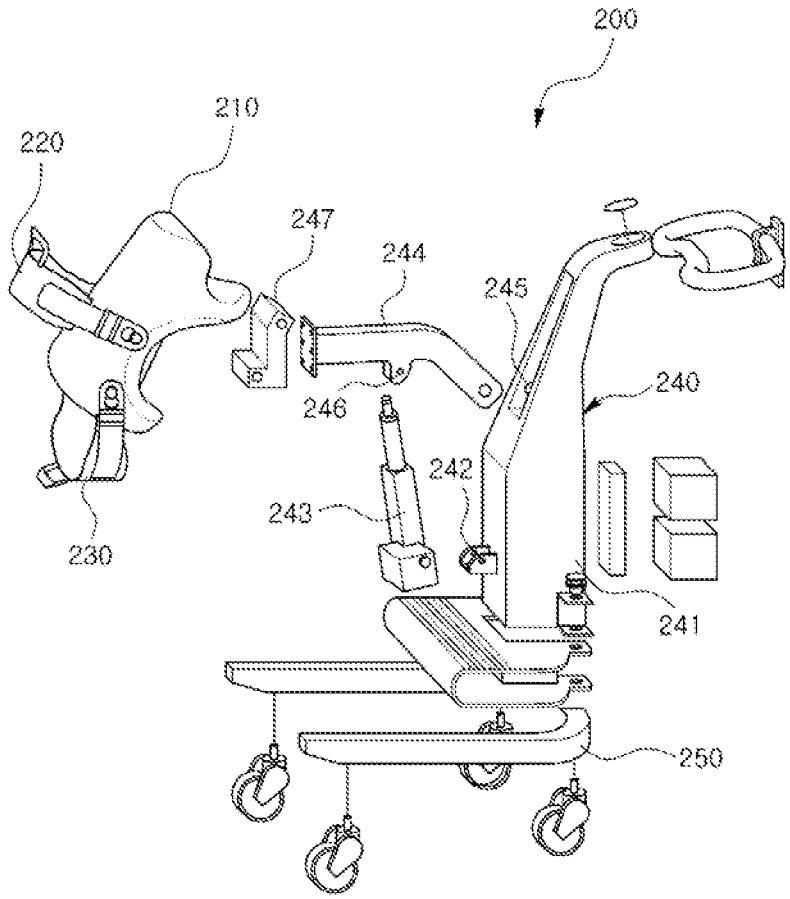
FIGS. 10 and 11 are views of a transfer robot for caring for a patient according to a second embodiment of the present invention.
Figure 11:
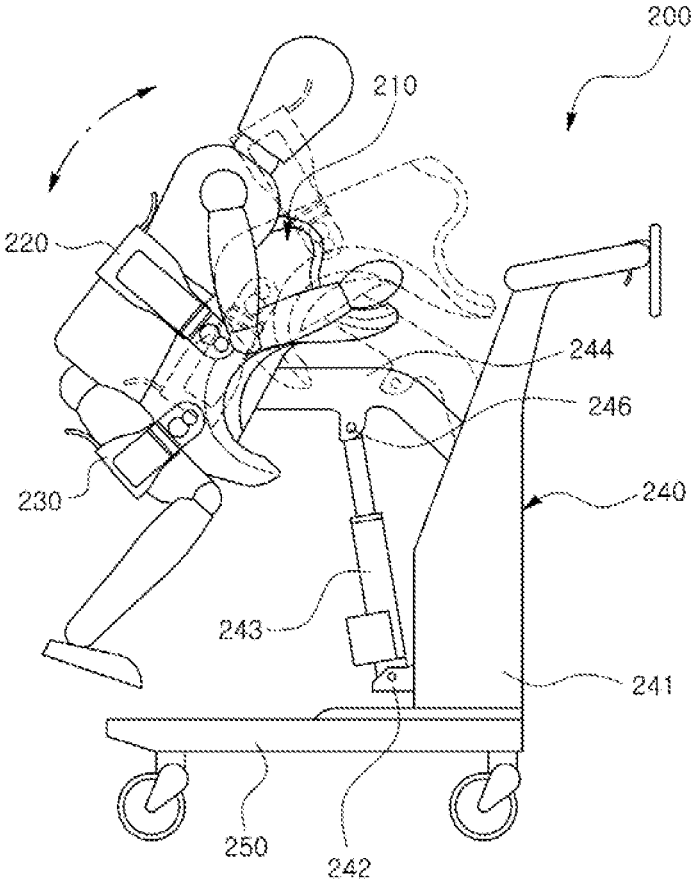

According to a second embodiment of the present invention as shown in FIGS. 10 and 11, a transfer robot includes a body section 210, a first clamp 220, a second clamp 230, a prop 240, and a transfer board 250.

Herein, the body section 210, the first clamp 220, the second clamp 230, and the transfer board 250 are the same as those of the first embodiment, and therefore a detailed description thereof will be omitted.

The prop 240 includes a post 241 installed vertically upward from the transfer board 250, a bracket 242 fixed to a planar surface of the post 241, a cylinder 243, a lower end of which is rotatably supported by the bracket 242, an arm member 244 rotatably supported by the post 241 via a rotary shaft 245 at one end and supporting the body section 210 via a fixing part 247 at the other end, and a fixing shaft 246 fixed to the arm member 244 to rotatably support the cylinder 243.

That is, according to the present embodiment, when an operation switch (not shown) mounted on a grip sends an up-signal to the cylinder 243, a rod (not shown) of the cylinder is accordingly drawn out to rotate and move the arm member 244 upwards relative to the rotary shaft 245. Herein, a patient can maintain a stable position, with his/her legs supported by the second clamp and his/her back of the upper half supported by the first clamp in a state of the upper half being carried on the body section 210. Since the body section is rotated and moved up during a moving-up stage, the patient can take a position in which the patient is carried on the body section as shown in FIG. 11, thereby allowing the patient to be moved in a comfortable position.

On the contrary, where the patient uses a bed, a chair, a toilet bowl or the like in a state of being carried on the body section, when the cylinder is moved down, the patient is rotated while being moved down, so that he/she can use the bed, the chair, the toilet bowl or the like while maintaining a stable position.

While the present embodiment employs the cylinder that is capable of being rotated while moving the body section, it is possible to employ the configuration in which a gear is connected to the rotary shaft of the arm member so that the body section is rotated and vertically moved by the rotation of the arm member via the rotation using the gear.

Although a variety of embodiments have been described in the description, they are provided to assist in understanding the technical content of the present invention, so it is not intended that the technical scope of the present invention is limited thereto.

That is, those skilled in the art will appreciate that various modifications, additions and substitutions are possible, without departing from the scope and spirit of the invention as disclosed in the accompanying claims. Of course, it should be construed that such modifications, additions and substitutions are defined within the technical scope of the present invention.

The invention claimed is:

1. A transfer robot for caring for a patient, comprising:

a body section against which the upper half of the body of a patient is leaned;

a first clamp which is rotatably provided on one side of the body section for supporting the upper half of the body of the patient;

a second clamp, which is provided at a position adjacent to the first clamp so that the position of the second clamp is able to be changed, for supporting the lower half of the body of the patient;

a prop which is extendedly arranged below the body section for adjusting the height of the body section; and a transfer board, which is connected to the prop, for rotating and moving positions, wherein the transfer board includes a frame having wheels and a connection part rotatably connecting the prop and the frame;

wherein the connection part includes a stepper allowing a gradational rotation of the prop; and wherein the stepper includes a housing provided on the prop with an internal space formed therein, a vertical shaft configured to vertically move in the housing in a state of being supported by a spring, and an extended shaft extending from a lower end of the vertical shaft and configured to be moved into and out of insertion holes, formed in an upper surface of a cylindrical member of the frame along a circumference thereof, in association with a vertical movement of the vertical shaft, allowing the prop to gradationally rotate about the frame.

2. The transfer robot according to claim 1, wherein the first clamp includes an elastic belt, and fixing protrusions configured to detachably connect the belt to the body section.

3. The transfer robot according to claim 2, wherein the body section has an inclined surface with which the patient comes into close contact.

4. The transfer robot according to claim 1, wherein the second clamp includes an elastic belt, and fixing protrusions configured to detachably connect the belt to the body section, wherein each of the fixing protrusions is configured to be fixedly moved along a slot formed in the body section to suit the length of the lower half of the patient so as to adjust a distance from the body section.

5. The transfer robot according to claim 4, wherein the second clamp is positioned to support the thighs of the patient at a position separated by 40 to 60% of the total length of the thighs from the knee joints.

6. The transfer robot according to claim 1, wherein the body section has an inclined surface with which the patient comes into close contact.

7. The transfer robot according to claim 6, wherein an inclined angle of the inclined surface ranges from 45 degrees to 65 degrees relative to an imaginary horizontal line.

8. The transfer robot according to claim 1, wherein the prop includes an upper casing connected to the body section, a lower casing inserted into the upper casing and connected to the transfer board, a lifting cylinder inserted into the upper and lower casings and connecting the body section and the transfer board, an operation lever provided on the body section to control the lifting cylinder, and a driver operating the lifting cylinder.

9. The transfer robot according to claim 8, wherein the body section includes a handle having the operation lever.

10. The transfer robot according to claim 8, wherein the transfer board includes a frame having wheels, a connection part rotatably connecting the prop and the frame, and a support part arranged between the frame and the connection part to support the driver.

11. The transfer robot according to claim 8, wherein the transfer board includes a support part arranged between the frame and the connection part to support the driver.

12. The transfer robot according to claim 1, wherein the stepper is a toggle clamp that is provided between the prop and the frame to allow the prop to be clamped to the frame.

13. The transfer robot according to claim 1, wherein at least one of the wheels includes a stopper.

14. The transfer robot according to claim 1, wherein the prop includes a post installed vertically upward from the transfer board, a bracket fixed to a planar surface of the post, a cylinder, a lower end of which is rotatably supported by the bracket, an arm member rotatably supported by the post via a rotary shaft at one end and supporting the body section via a fixing part at the other end, and a fixing shaft fixed to the arm member to rotatably support the cylinder.

15. The transfer robot according to claim 1, wherein the insertion holes are equidistantly formed in the upper surface of the cylindrical member of the frame.

* * * * *